US006524499B1

(12) United States Patent
Takamiya et al.

(10) Patent No.: US 6,524,499 B1
(45) Date of Patent: Feb. 25, 2003

(54) TRANSPARENT CONDUCTIVE FILM AND DISPLAY DEVICE

(75) Inventors: Naoki Takamiya, Tokyo (JP); Hideki Horikoshi, Tokyo (JP); Kazutomo Mori, Tokyo (JP); Tadashi Neya, Tokyo (JP)

(73) Assignee: Sumitomo Osaka Cement Co., Ltd. (JP)

( * ) Notice: Subject to any disclaimer, the term of this patent is extended or adjusted under 35 U.S.C. 154(b) by 0 days.

(21) Appl. No.: 10/110,033

(22) PCT Filed: Aug. 10, 2001

(86) PCT No.: PCT/JP01/06912

§ 371 (c)(1),
(2), (4) Date: Apr. 5, 2002

(87) PCT Pub. No.: WO02/15201

PCT Pub. Date: Feb. 21, 2002

(30) Foreign Application Priority Data

Aug. 11, 2000 (JP) ..... 2000-245350

(51) Int. Cl.[7] ..... H01B 1/02; C23C 18/31; H01J 31/00

(52) U.S. Cl. ..... 252/514; 252/512; 252/514; 106/1.05; 106/1.13; 106/1.15; 106/1.19; 106/1.21; 106/1.23; 106/1.24; 106/1.28; 438/434; 438/444; 423/22; 423/23; 345/3.1; 345/5

(58) Field of Search ..... 252/512, 514; 106/1.05, 1.13, 1.15, 1.19, 1.21, 1.23, 1.24, 1.28; 438/434, 444; 423/23, 22; 345/3.1, 5

(56) References Cited

U.S. PATENT DOCUMENTS

| | | | | |
|---|---|---|---|---|
| 6,086,790 A | * | 7/2000 | Hayashi et al. | 106/1.05 |
| 6,143,418 A | * | 11/2000 | Takamiya et al. | 428/434 |
| 6,351,063 B1 | * | 2/2002 | Lee et al. | 313/479 |

FOREIGN PATENT DOCUMENTS

| | | | | |
|---|---|---|---|---|
| JP | 8-077832 | | 3/1996 | 252/503 |
| JP | 10-001777 | * | 1/1998 | C23C/18/31 |
| JP | 10-261326 | * | 9/1998 | H01B/13/00 |
| JP | 11-25759 | | 1/1999 | |
| JP | 11-025759 | * | 1/1999 | H01B/5/14 |
| JP | 11-80619 | | 3/1999 | |
| JP | 11-080618 | * | 3/1999 | C09D/5/24 |
| JP | 11-080619 | * | 3/1999 | C09D/5/24 |
| JP | 2000-276941 | * | 10/2000 | H01B/1/00 |
| JP | 2000-357414 | | 12/2000 | |

OTHER PUBLICATIONS

English translation of Abstract of above–cited JP8077832 dated Mar. 22, 1996 (252/503).

* cited by examiner

*Primary Examiner*—Mark Kopec
*Assistant Examiner*—Kallambella Vijayakumar
(74) *Attorney, Agent, or Firm*—Ostrolenk, Faber, Gerb & Soffen, LLP

(57) ABSTRACT

The transparent conductive film of the present invention is formed to have a conductive layer containing at least ruthenium fine particles, gold fine particles and silver fine particles, the weight ratio of ruthenium fine particles and gold fine particles in the conductive layer being within the range of 40:60 to 99:1. As a result, this transparent conductive film and a display device having this transparent conductive film have superior electromagnetic wave shielding effects and anti-reflection effects, high chemical stability and superior visibility.

8 Claims, No Drawings

TRANSPARENT CONDUCTIVE FILM AND DISPLAY DEVICE

BACKGROUND OF THE INVENTION

1. Technical Field

The present invention relates to a transparent conductive film and a display device in which this transparent conductive film is formed on a display screen, and more particularly, to a transparent conductive film having superior anti-static effects and electromagnetic wave shielding effects using a display screen such as a cathode ray tube or plasma display, high contrast by demonstrating black color in which dark areas are tinted with a blue hue for which the human eye most strongly senses black coloring when viewing transmitted images, and superior chemical stability, as well as a display device in which this transparent conductive film is formed on a display screen.

2. Background Art

Since cathode ray tubes, which are one kind of display device used for the displays of television picture tubes, computers and so forth, depict characters and images on a display screen by bombarding an electron beam onto a fluorescent screen that emits red, green and blue colors, in addition to dust becoming adhered due to static electricity generated on this display screen and lowering visibility, there is also the risk of radiation of electromagnetic waves that have a detrimental effect on the environment.

In addition, plasma displays for which applications have progressed for use as wall-mounted televisions have also been pointed out as having the potential to generate static electricity and radiate electromagnetic waves.

In order to solve these problems, Japanese Unexamined Patent Application, First Publication No. 8-77832, for example, proposes an invention comprising a transparent metal thin film made of fine metal particles at least containing silver and having a mean particle size of 2–200 nm, and a transparent thin film having a different refractive index than said transparent metal thin film, for use as a transparent conductive film having superior electromagnetic wave shielding effects and anti-reflection effects.

However, in these methods of the prior art, although electromagnetic wave shielding effects can be anticipated, the problem of absorbance of transmitted light at 400–500 nm occurring dependent on the optical transmission spectrum of silver, yellowing of the conductive film, and the hue of transmitted images being tinted with a yellow color thereby preventing the display of deep black color and resulting in decreased image contrast, as well as the problem of the surface resistance value of the conductive film rising when immersed in a chemical solution due to its low chemical stability resulting in a decrease in electromagnetic wave shielding effects and requiring that caution be used during handling, were not solved.

In order to solve the above problems, the object of the present invention is to provide a transparent conductive film having superior electromagnetic wave shielding effects and anti-reflection effects, black color tinted with blue color for which the hue of transmitted images is generally considered to have a deep black color, and high chemical stability, as well as a display device in which this transparent conductive film is formed on a display screen.

DISCLOSURE OF THE INVENTION

In order to solve the above problems, the present invention provides a transparent conductive film having a conductive layer at least containing ruthenium fine particles and gold fine particles or ruthenium fine particles, gold fine particles and silver fine particles.

The inventors of the present invention found that as a result of a conductive layer at least containing ruthenium fine particles, and gold fine particles or ruthenium fine particles, gold fine particles and silver fine particles, the transparent conductive film has sufficient electrical conductivity for demonstrating anti-static effects and electromagnetic wave shielding effects, has satisfactory weather resistance as exemplified by salt water resistance, and when this transparent conductive film is formed on the display screen of a display device, the color tone of transmitted images are black tinted with blue resulting in natural hue and high image contrast, thereby enabling the obtaining of a display device having satisfactory visibility.

The weight ratio of the ruthenium fine particles to gold fine particles in the above conductive layer is preferably within the range of 40:60 to 99:1. In addition, silver fine particles are preferably contained at 1–70 wt % relative to the total amount of ruthenium fine particles and gold fine particles.

If the ratio of gold fine particles exceeds the above ratio, the refractive index of the conductive layer changes resulting in poor reflection characteristics, while if the ratio is lower than the above ratio, the problem of decreased electrical conductivity occurs.

In addition, the above conductive layer is preferably formed by applying a coating containing at least ruthenium fine particles and gold fine particles or a coating containing at least ruthenium fine particles, gold fine particles and silver fine particles.

As a result of containing a conductive layer formed using the above coating (to be hereinafter referred to as the "conductive layer forming coating"), the transparent conductive film of the present invention has superior anti-static effects and electromagnetic wave shielding effects, satisfactory weather resistance as exemplified by salt water resistance, and a coated film is obtained having extremely few film defects caused by aggregates of coating components and so forth.

The transparent conductive film of the present invention may also contain a colorant.

Although the transparent conductive film of the present invention improves contrast as a result of the conductive layer containing ruthenium fine particles and gold fine particles which cause the color tone of transmitted images to become black tinted with blue, by containing a colorant in the above conductive layer or at least any one of the other layers, the transparent conductive film can be imparted with the function of a selective absorption filter, thereby making transmitted images of the transparent conductive film extremely vivid.

At least one transparent layer having a refractive index different from that of the above conductive layer is preferably laminated for the upper layer and/or lower layer of the above conductive layer.

As a result of laminating the above transparent layer, the anti-reflection performance of the transparent conductive film is improved, and entrance of external light and haze become extremely low.

In addition, the present invention provides a display device in which any of the above-mentioned transparent conductive films is formed on a display screen.

As a result of having the above transparent conductive film formed on a display screen, this display device has superior anti-static effects and electromagnetic wave shielding effects, satisfactory weather resistance as exemplified by salt water resistance, high contrast as a result of the color tone of transmitted images demonstrating black color tinted with blue, and in the case of the conductive layer being formed by applying the above conductive layer forming coating, the appearance of the coated film is smooth with extremely few film defects caused by aggregates of coating components and so forth. In addition, in the case of the transparent conductive film containing a colorant, transmitted images become extremely vivid. Moreover, if the transparent conductive film has the previously mentioned transparent layer, visibility can be further improved by improving anti-reflection effects.

BEST MODE FOR CARRYING OUT THE INVENTION

The following provides an explanation of modes for carrying out the invention using preferable specific examples.

As a result of conducting earnest research on a transparent conductive film formed by applying a coating containing metal fine particles to as to impart superior visibility and electromagnetic wave shielding effects to the display screen of a display device, the inventors of the present invention found that a transparent conductive film, in which a thin film, formed particularly using a coating in which ruthenium fine particles and gold fine particles and preferably colorant are uniformly dispersed, is heat-treated, has superior color tone and chemical stability, as well as superior electrical conductivity performance and anti-reflection performance, thereby leading to completion of the present invention.

The conductive layer in the transparent conductive film of the present invention is obtained by performing heat treatment on a thin film formed using a coating containing ruthenium fine particles and gold fine particles (conductive layer forming coating), and together with having high electrical conductivity and high chemical stability, images transmitted through this conductive layer retain color tone that is comparatively close to natural light. With respect to the color tone of transmitted images in particular, the content of metal fine particles is such that the weight ratio of ruthenium to gold is within the range of 40:60 to 99:1, preferably within the range of 50:50 to 99:1 and more preferably within the range of 50:50 to 75:25. The color tones of ruthenium and gold alone as metals is such that Ru is absorbed in the short wavelength region (wavelength region in which blue color is emitted) and results in a so-called yellow-tinted black color, while Au exhibits blue color which is the peak of the wavelength region in which blue color is emitted). The blue-tinted black color demonstrated in the present invention can be obtained by combining these two metals. If the ratio of ruthenium to gold is greater than 40:60, blue color becomes excessively strong, and moves away from the blue-tinted black color that most strongly accentuates black color, the object of the present invention. Conversely, if the ratio of ruthenium to gold is smaller than 99:1, the effect of the addition of metal is eliminated and as a result, black color results in which the inherent yellow color of the ruthenium is stronger. In addition, the use of ruthenium and gold allows the obtaining of a transparent conductive film having superior chemical stability.

In the present invention, if at least ruthenium fine particles and gold fine particles are contained in the conductive layer, although other metal particles, oxide particles, colorant and so forth may also be contained as necessary, it is preferable to additionally contain silver fine particles. Although silver fine particles cause yellowing of the conductive film and result in the hue of transmitted images having a strong yellow color if used alone, when used in combination with ruthenium fine particles and gold fine particles, transmitted images take on a black color satisfactorily tinted with blue. In addition, if silver fine particles are contained, electrical conductivity improves and a conductive film can be obtained having both superior color tone and electrical conductivity. The content of silver fine particles is preferably 1–70 wt %, more preferably 5–50 wt %, and even more preferably 10–30 wt %, relative to the total amount of ruthenium fine particles and gold fine particles.

The particle size of the ruthenium fine particles, gold fine particles and silver fine particles used in the conductive layer forming coating is preferably within the range of 1–50 nm, and more preferably within the range of 2–30 nm. If the particle size of individual metal fine particles is less than 1 nm, the properties of the fine particles as a metal are lost which is undesirable since this causes a decrease in electrical conductivity. In addition, if the particle size exceeds 50 nm, there is a strong tendency for ruthenium fine particles, gold fine particles and silver particles to aggregate in the coating, which is also undesirable since it makes it difficult to form a uniform coated film.

The transparent conductive film of the present invention is able to impart the function of a selective absorption filter to the transparent conductive film by containing a colorant in at least one of any of its layers. Consequently, the main wavelength portions of the three elementary colors of red, green and blue can be selectively absorbed resulting in improved color contrast and allowing the obtaining of vivid transmitted images.

Although the above colorant may be blended into any of the layers that form the transparent conductive film, in the case of blending into the conductive layer, the blended amount is 20 wt % or less, and particularly preferably 10 wt % or less, relative to the content of metal fine particles. If the blended amount exceeds 20 wt %, decreased electrical conductivity and inferior film strength are observed, thereby causing impairment of electromagnetic wave shielding effects.

Examples of colorants that can be used include organic and inorganic pigments such as monoazo pigment, quiinacridone, iron oxide yellow, disazo pigment, phthalocyanine green, phthalocyanine blue, cyanine blue, flavanthrone yellow, dianthraquinolyl red, indanthrone blue, thioindigo bordeaux, perylene green, perylene scarlet, perylene red 178, perylene maroon, dioxadine violet, isoindoline yellow, nickel nitroso yellow, madder lake, copper azomethine yellow, aniline black, alkaline blue, zinc oxide, titanium oxide, iron oxide red, chromium oxide, iron oxide black, titanium yellow, cobalt blue, cerian blue, cobalt green, alumina white, viridian, cadmium yellow, cadmium red, vermilion, lithopone, chrome yellow, molybdate orange, zinc chromate, calcium sulfate, barium sulfate, calcium carbonate, lead white, ultramarine, manganese violet, emerald green, navy blue and carbon black, various types of dyes such as azo dye, anthraquinone dye, indigoid dye, phthalocyanine dye, carbonium dye, quinone imine dye, methine dye, quinoline dye, nitro dye, nitroso dye, benzoquinone dye, naphthoquinone, naphthalimide dye and perynone dye. These colorants can be used alone or as a combination of two or more kinds.

The kind and amount of colorant used should be suitably selected according to the optical film characteristics of the corresponding transparent conductive film. Absorbance A of the transparent conductive film is typically expressed with the following equation:

$$A=\log_{10}(I_0/I)=\epsilon CD$$

wherein, $I_0$: incident light, I: transmitted light, C: color density, D: optical distance and $\epsilon$: molar absorption coefficient.

A colorant having a molar absorption coefficient of $\epsilon>10$ is typically used in the transparent conductive film of the present invention. In addition, although the blended amount of colorant varies dependent upon the molar absorption coefficient of the colorant used, it is preferably an amount such that the absorbance A of the laminated film and single layer film in which the colorant is blended is within the range of 0.0004–0.0969 abs. Failure to satisfy these conditions causes a decrease in transparency and/or anti-reflection effects.

In addition to the metal fine particles mentioned above, the conductive layer in the transparent conductive film of the present invention may also contain silica fine particles having a mean particle size of 100 nm or less within the range of 1–80 wt % relative to the above metal fine particles. A conductive layer in which a film has been formed by applying the above conductive layer forming coating containing silica fine particles has remarkably improved film strength and improved scratch strength. In addition, as a result of containing silica fine particles in the conductive layer, in the case of providing one or more transparent layers in its upper layer and/or lower layer that has a refractive index that differs from the refractive index of the conductive layer, there is the advantage of improved adhesion between both layers due to the satisfactory wettability with the silica binder component of the transparent layer, while also further improving scratch strength. Silica fine particles are even more preferably contained within the range of 20–80 wt %, relative to the metal fine particles from the viewpoint of achieving both improved film strength and electrical conductivity.

In addition, besides the above components, the above conductive layer may also contain other components as necessary for the purpose of improving film strength and electrical conductivity, examples of which include inorganic fine particles having for their main component oxides, compound oxides or nitrides of silicon, aluminum, zirconium, cerium, titanium, yttrium, zinc, magnesium, indium, tin, antimony and gallium, and particularly oxides, compound oxides or nitrides of yttrium and tin, organic synthetic resins such as polyester resin, acrylic resin, epoxy resin, melamine resin, urethane resin, butyral resin and ultraviolet cured resins, hydrolysis products of metal alkoxides of metals such as silicon, titanium and zirconium, and organic and inorganic binder components such as silicone monomer and silicone oligomer.

In applying the above conductive layer forming coating containing at least metal fine particles onto a substrate, any ordinary thin film coating technology can be used such as spin coating, roll coating, spraying, bar coating, dipping, meniscus coating and gravure printing. Among these, spin coating is particularly preferable since a thin film of uniform thickness can be formed in a short period of time.

In addition, in addition to being inexpensive, spray coating allows the nozzle speed, nozzle height and so forth to be altered during spray coating, thereby making it possible to change the film thickness within the same plane and create a distribution of film thickness by changing these parameters. Since many of the substrates used for display screens have differences in wall thickness within their surface, if a film of uniform thickness is formed on the surface of the substrate, the distribution of transmittance within the display screen is not uniform due to the differences in wall thickness of the substrate, resulting in coarse display images that lack uniformity. Therefore, when the thickness of the inner surface of cathode ray tube panel is thinner in the center and thicker around the periphery as with the cathode ray tube panels of flat screen televisions, by making the thickness of the conductive film formed on the surface thicker in the center and thinner around the periphery, it is possible to make transmittance uniform within the display screen in which the cathode ray tube panel and conductive film are combined. Consequently, in the case of depicting images, since there is no longer any distribution of transmittance within the display screen, extremely uniform display images can be obtained.

The electrical conductivity performance of the transparent conductive film required to demonstrate an anti-static function as well as electromagnetic wave shielding effects is expressed by the following Equation 1.

$$S=50+10\log(1/\rho f)+1.7t\sqrt{(f\rho)} \qquad \text{Eq. 1}$$

wherein,

S (dB): Electromagnetic wave shielding effects,

ρ(ΩQ·cm): Volumetric specific resistance of conductive film, f (MHz): Electromagnetic wave frequency, and t (cm): Film thickness of conductive film.

Here, since it is preferable that film thickness t be about 1 $\mu$m ($1\times10^{-4}$ cm) or less from the viewpoint of optical transmittance, if the term containing film thickness t in Equation 1 is ignored, electromagnetic wave shielding effects S can approximately be expressed with the following Equation 2:

$$S=50+10\log(1/\rho f) \qquad \text{Eq. 2}$$

Here, electromagnetic wave shielding effects are larger the greater the value of S (dB).

In general, although electromagnetic wave shielding effects are considered to be superior if S>60 dB, electromagnetic wave shielding effects of S>80 dB are desired with respect to the conductive films of display screens in particular. In addition, since the frequency of electromagnetic waves, which is subject to regulation, is typically within the range of 10 kHz to 1000 MHz, the electrical conductivity of transparent conductive films is required to have a volumetric specific resistance value (ρ) of $10^5$ Ω·cm or less. Namely, the lower the volumetric specific resistance value (ρ) of a transparent conductive film, the more effectively it is able to shield electromagnetic waves over a broader frequency range. In order to satisfy this condition, it is necessary that the film thickness, of the conductive layer in the transparent conductive film be 10 nm or more, and that it contain 10 wt % or more of metal fine particles. In the case the film thickness is less than 10 nm or the content of metal fine particles is less than 10 wt %, electrical conductivity decreases, thereby making it difficult to obtain substantial electromagnetic wave shielding effects.

The transparent conductive film of the present invention preferably has at least one transparent layer laminated for the upper layer and/or lower layer of the above conductive layer. This transparent layer preferably has a refractive index that differs from the refractive index of the conductive layer. As a result, not only does it protect the conductive layer, but it also is able to effectively remove or diminish reflection of external light at the interlayer interface of the resulting transparent conductive film.

Examples of materials used to form the transparent layer include thermoplastic, heat-cured or photo- or electron beam-cured resins such as polyester resin, acrylic resin, epoxy resin and butyral resin, hydrolysis products of the alkoxides of metals such as silicon, aluminum, titanium and zirconium, and silicone monomers or oligomers either alone or as a mixture.

A particularly preferable transparent layer is an $SiO_2$ thin film having a high surface hardness of the film and a comparatively low refractive index. Examples of materials able to form this $SiO_2$ thin film include compounds represented with the following formula:

$$M(OR)_mR_n$$

(wherein, M represents Si, R represents a $C_1$–$C_4$ alkyl group, m represents an integer of 1–4, n represents an integer of 0–3, and m+n is 4), or a mixture of one or more kinds of their partial hydrolysis products. Tetraethoxysilane ($Si(OC_2H_5)_4$), which is an example of a compound having the above formula, is used preferably from the viewpoints of ease of forming a thin film, transparency, adhesion with the conductive layer, film strength and anti-reflection performance.

The above transparent layer may contain various resins, metal oxides, compound oxides or nitrides, or precursors able to form them as a result of baking, provided they can be set to a refractive index that differs from that of the conductive layer.

Similar to the method used to form the conductive layer, formation of the transparent layer can be carried out by a film forming method in which a coating liquid containing the above components (to be referred to as the "transparent layer forming coating") is uniformly applied. Any ordinary thin film coating technology can be used for coating, examples of which include spin coating, roll coating, spraying, bar coating, dipping, meniscus coating and gravure printing. Among these, spin coating is a particularly preferable coating method since a thin film of uniform thickness can be formed in a short period of time. After coating, a transparent film is obtained by drying the coated film and baking with the conductive layer at 100–500° C.

Since interlayer interface anti-reflection performance of a multi-layer thin film is typically determined by the refractive index and film thickness of the thin film as well as the number of laminated thin films, in the transparent conductive film of the present invention as well, effective anti-reflection performance can be obtained by designing the thicknesses of the respective conductive and transparent layers in consideration of the number of laminated layers of the conductive layer and transparent layer.

In the case of a multi-layer films capable of preventing reflection, when the wavelength of the reflected light to be prevented is taken to be $\lambda$, reflection can be effectively prevented by using optical film thicknesses of $\lambda/4$ and $\lambda/4$ or $\lambda/2$ and $\lambda/4$, respectively, for the high refractive index layer and low refractive index layer from the substrate side in the case of an anti-reflecting film composed of two layers.

In addition, in the case of an anti-reflecting film composed of three layers, it is effective to use optical film thicknesses of $\lambda/4$, $\lambda/2$ and $\lambda/4$ or in that order for the intermediate refractive index layer, high refractive index layer and low refractive index layer from the substrate.

In consideration of production ease and economic feasibility in particular, it is preferable form on the upper layer of the conductive layer an $SiO_2$ film (refractive index: 1.46) having a comparatively low refractive index and compatible and capable of forming a hard coating at a film thickness of $\lambda/4$.

In the transparent conductive film of the present invention containing a conductive layer and a transparent layer, baking of the conductive layer and transparent layer may be carried out sequentially or simultaneously. For example, the conductive layer and transparent layer can be formed simultaneously to form a low reflecting transparent conductive film by applying a conductive layer forming coating to the display screen of a display device, applying a transparent layer forming coating to its upper layer and then baking both at a temperature of 100–500° C. after drying.

A transparent layer having surface irregularities is preferably provided on the outermost layer of the above transparent conductive film. This irregular surface layer has the effect of imparting superior anti-glare properties to the display screen by scattering surface reflected light of the transparent conductive film. Silica is preferable for the material of this irregular surface layer from the viewpoints of surface hardness and refractive index. This irregular surface layer can be formed by applying an irregular surface layer forming coating as the outermost layer of the above transparent conductive film by various coating methods in the same manner as previously described, and simultaneously or separately baking at a temperature of 100–500° C. Spin coating is particularly preferable for the coating method of the irregular surface layer.

The display device of the present invention has any of the above transparent conductive films formed on a display screen. This display device is not subjected to the adhesion of dust and so forth to the image display screen since static electricity on the display screen is prevented, various kinds of electromagnetic wave interference are prevented since it is shielded from electromagnetic waves, the images are bright due to its superior light transmittance, the hue of transmitted images is natural and they have high contrast, the appearance of the display screen is smooth, and there are hardly any restrictions on handling due to its high chemical stability. In addition, if the above transparent layer and/or irregular surface layer is formed in addition to the conductive layer, superior anti-reflecting effects and/or anti-glare effects are obtained with respect to external light.

EMBODIMENTS

Although the following provides a detailed explanation of the present invention through its embodiments, the present invention is not limited by these embodiments.

The following base liquids were prepared for use in the embodiments and comparative examples.

(Ruthenium Aqueous Sol)

An aqueous solution containing 0.15 millimoles/liter of ruthenium chloride and a 0.024 millimoles/liter aqueous solution of sodium borohydride were mixed, and the resulting colloidal dispersion was concentrated to obtain an aqueous sol containing 0.198 moles/liter of ruthenium fine particles. The mean particle size of the ruthenium fine particles was 10 nm.

(Gold Aqueous Sol)

An aqueous solution containing 0.15 millimoles/liter of gold chloride and 0.024 millimoles/liter of sodium borohydride were mixed, and the resulting colloidal dispersion was concentrated to obtain an aqueous sol containing 0.102 moles/liter of gold fine particles. The mean particle size of the gold fine particles was 6 nm.

(Silver Aqueous Sol)

An aqueous solution (25 g) at pH 5.9 in which silver nitrate (2.5 g) was dissolved was added to an aqueous solution (60 g) at 5° C. in which sodium citrate dehydrate (14 g) and ferrous sulfate (14 g) were dissolved to obtain a reddish-brown silver sol. This silver sol was washed with water by centrifugal separation, and after removing the impurity ions, pure water was added to obtain an aqueous sol containing 0.185 moles/liter of silver fine particles.

(Transparent Thin Film Coating A)

Tetraethoxysilane (0.8 g), 0.1 N hydrochloric acid (0.8 g) and ethyl alcohol (98.4 g) were mixed to obtain a uniform solution.

(Colloidal Silica)

Silicadol 30 made by Nihon Chemical Industrial Co., Ltd was used.

Embodiment 1

Preparation of Conductive Layer Forming Coating 9 g of the above ruthenium sol, 1 g of the gold aqueous sol, 0.1 g of the colloidal silica, 10 g of ethyl cellusorb and 79.9 g of ethyl alcohol were mixed by stirring, and the resulting mixture was dispersed with an ultrasonic disperser (Branson Ultrasonics, Sonifier 450) to prepare a conductive layer forming coating. The weight ratio of Ru:Au in the coating was 90:10, and the weight ratio of metal fine particles:$SiO_2$ was 100:20.

Film Formation

The above conductive layer forming coating was applied to the display screen of a cathode ray tube using a spin coater, and after drying, the above transparent layer forming coating was similarly applied to this coated surface using a spin coater. This cathode ray tube was then placed in a dryer and baked for one hour at 150° C. to form a transparent conductive film and produce the cathode ray tube of Embodiment 1 having an anti-reflecting transparent conductive film.

Embodiment 2

Preparation of Conductive Layer Forming Coating 6 g of the above ruthenium sol, 4 g of the gold aqueous sol, 0.1 g of the colloidal silica, 10 g of ethyl cellusorb and 79.9 g of ethyl alcohol were mixed by stirring, and the resulting mixture was dispersed with an ultrasonic disperser (Branson Ultrasonics, Sonifier 450) to prepare a conductive layer forming coating. The weight ratio of Ru:Au in the coating was 60:40, and the weight ratio of metal fine particles:$SiO_2$ was 100:20.

Film Formation

The above conductive layer forming coating was applied to the display screen of a cathode ray tube using a spin coater, and after drying, the above transparent layer forming coating was similarly applied to this coated surface using a spin coater. This cathode ray tube was then placed in a dryer and baked for one hour at 150° C. to form a transparent conductive film and produce the cathode ray tube of Embodiment 2 having an anti-reflecting transparent conductive film.

Embodiment 3

Preparation of Conductive Layer Forming Coating 6 g of the above ruthenium sol, 4 g of the gold aqueous sol, 0.1 g of the colloidal silica, 0.1 g of a blue pigment dispersion (Sanyo Color Works, Ltd, Sandye Super Blue KR), 10 g of ethyl cellusorb and 79.8 g of ethyl alcohol were mixed by stirring, and the resulting mixture was dispersed with an ultrasonic disperser (Branson Ultrasonics, Sonifier 450) to prepare a conductive layer forming coating. The weight ratio of Ru:Au in the coating was 60:40, and the weight ratio of metal fine particles:$SiO_2$ was 100:20, and the weight ration of metal fine particles:pigment was 100:10.

Film Formation

The above conductive layer forming coating was applied to the display screen of a cathode ray tube using a spin coater, and after drying, the above transparent layer forming coating was similarly applied to this coated surface using a spin coater. This cathode ray tube was then placed in a dryer and baked for one hour at 150° C. to form a transparent conductive film and produce the cathode ray tube of Embodiment 3 having an anti-reflecting transparent conductive film.

Embodiment 4

Preparation of Conductive Layer Forming Coating 4 g of the above ruthenium sol, 6 g of the gold aqueous sol, 0.1 g of the colloidal silica, 10 g of ethyl cellusorb and 79.9 g of ethyl alcohol were mixed by stirring, and the resulting mixture was dispersed with an ultrasonic disperser (Branson Ultrasonics, Sonifier 450) to prepare a conductive layer forming coating. The weight ratio of Ru:Au in the coating was 40:60, and the weight ratio of metal fine particles:$SiO_2$ was 100:20.

The above conductive layer forming coating was applied to the display screen of a cathode ray tube using a spin coater, and after drying, the above transparent layer forming coating was similarly applied to this coated surface using a spin coater. This cathode ray tube was then placed in a dryer and baked for one hour at 150° C. to form a transparent conductive film and produce the cathode ray tube of Embodiment 4 having an anti-reflecting transparent conductive film.

Embodiment 5

Preparation of Conductive Layer Forming Coating 4.5 g of the above ruthenium sol, 4.5 g of the gold aqueous sol, 1 g of the silver aqueous sol, 0.1 g of the colloidal silica, 10 g of ethyl cellusorb and 79.9 g of ethyl alcohol were mixed by stirring, and the resulting mixture was dispersed with an ultrasonic disperser (Branson Ultrasonics, Sonifier 450) to prepare a conductive layer forming coating. The weight ratio of Ru:Au in the coating was 50:50, and the amount of Ag was 11 wt % of the total of Ru and Au. In addition, the weight ratio of metal fine particles:$SiO_2$ was 100:20.

The above conductive layer forming coating was applied to the display screen of a cathode ray tube using a spin coater, and after drying, the above transparent layer forming coating was similarly applied to this coated surface using a spin coater. This cathode ray tube was then placed in a dryer and baked for one hour at 150° C. to form a transparent conductive film and produce the cathode ray tube of Embodiment 5 having an anti-reflecting transparent conductive film.

Embodiment 6

Preparation of Conductive Layer Forming Coating 5.4 g of the above ruthenium sol, 3.6 g of the gold aqueous sol, 1 g of the silver aqueous sol, 0.1 g of the colloidal silica, 10 g of ethyl cellusorb and 79.9 g of ethyl alcohol were mixed by stirring, and the resulting mixture was dispersed with an ultrasonic disperser (Branson Ultrasonics, Sonifier 450) to prepare a conductive layer forming coating. The weight ratio of Ru:Au in the coating was 60:40, and the amount of Ag was 11 wt % of the total of Ru and Au. In addition, the weight ratio of metal fine particles:$SiO_2$ was 100:20.

The above conductive layer forming coating was applied to the display screen of a cathode ray tube using a spin coater, and after drying, the above transparent layer forming coating was similarly applied to this coated surface using a spin coater. This cathode ray tube was then placed in a dryer and baked for one hour at 150° C. to form a transparent conductive film and produce the cathode ray tube of Embodiment 6 having an anti-reflecting transparent conductive film.

Comparative Example 1

Preparation of Conductive Layer Forming Coating 10 g of the above ruthenium sol, 0.1 g of the colloidal silica, 10 g of ethyl cellusorb and 79.9 g of ethyl alcohol were mixed by stirring, and the resulting mixture was dispersed with an ultrasonic disperser (Branson Ultrasonics, Sonifier 450) to prepare a conductive layer forming coating. The weight ratio of metal fine particles:$SiO_2$ was 100:20.

Film Formation

The above conductive layer forming coating was applied to the display screen of a cathode ray tube using a spin coater, and after drying, the above transparent layer forming coating was similarly applied to this coated surface using a spin coater. This cathode ray tube was then placed in a dryer and baked for one hour at 150° C. to form a transparent conductive film and produce the cathode ray tube of Comparative Example 1 having an anti-reflecting transparent conductive film.

Comparative Example 2

Preparation of Conductive Layer Forming Coating 10.0 g of the above silver aqueous sol, 0.1 g of the colloidal silica, 10 g of ethyl cellusorb and 79.9 g of ethyl alcohol were mixed by stirring, and the resulting mixture was dispersed with an ultrasonic disperser (Branson Ultrasonics, Sonifier 450) to prepare a conductive layer forming coating. The weight ratio of metal fine particles:$SiO_2$ was 100:20.

Film Formation

The above conductive layer forming coating was applied to the display screen of a cathode ray tube using a spin coater, and after drying, the above transparent layer forming coating was similarly applied to this coated surface using a spin coater. This cathode ray tube was then placed in a dryer and baked for one hour at 150° C. to form a transparent conductive film and produce the cathode ray tube of Comparative Example 2 having an anti-reflecting transparent conductive film.

Comparative Example 3

Preparation of Conductive Layer Forming Coating 9.95 g of the above ruthenium sol, 0.05 g of the gold aqueous sol, 0.1 g of the colloidal silica, 10 g of ethyl cellusorb and 79.9 g of ethyl alcohol were mixed by stirring, and the resulting mixture was dispersed with an ultrasonic disperser (Branson Ultrasonics, Sonifier 450) to prepare a conductive layer forming coating. The weight ratio of Ru:Au in the coating was 99.5:0.5, and the weight ratio of metal fine particles:$SiO_2$ was 100:20.

Film Formation

The above conductive layer forming coating was applied to the display screen of a cathode ray tube using a spin coater, and after drying, the above transparent layer forming coating was similarly applied to this coated surface using a spin coater. This cathode ray tube was then placed in a dryer and baked for one hour at 150° C. to form a transparent conductive film and produce the cathode ray tube of Comparative Example 3 having an anti-reflecting transparent conductive film.

Comparative Example 4

Preparation of Conductive Layer Forming Coating 3 g of the above ruthenium sol, 7 g of the gold aqueous sol, 0.1 g of the colloidal silica, 10 g of ethyl cellusorb and 79.9 g of ethyl alcohol were mixed by stirring, and the resulting mixture was dispersed with an ultrasonic disperser (Branson Ultrasonics, Sonifier 450) to prepare a conductive layer forming coating. The weight ratio of Ru:Au in the coating was 30:70, and the weight ratio of metal fine particles:$SiO_2$ was 100:20.

Film Formation

The above conductive layer forming coating was applied to the display screen of a cathode ray tube using a spin coater, and after drying, the above transparent layer forming coating was similarly applied to this coated surface using a spin coater. This cathode ray tube was then placed in a dryer and baked for one hour at 150° C. to form a transparent conductive film and produce the cathode ray tube of Comparative Example 4 having an anti-reflecting transparent conductive film.

Comparative Example 5

Preparation of Conductive Layer Forming Coating 2.5 g of the above ruthenium sol, 2.5 g of the gold aqueous sol, 5 g of the silver aqueous sol, 0.1 g of the colloidal silica, 10 g of ethyl cellusorb and 79.9 g of ethyl alcohol were mixed by stirring, and the resulting mixture was dispersed with an ultrasonic disperser (Branson Ultrasonics, Sonifier 450) to prepare a conductive layer forming coating. The weight ratio of Ru:Au in the coating was 50:50, and the amount of Ag was 100 wt % of the total of Ru and Au. In addition, the weight ratio of metal fine particles:$SiO_2$ was 100:20.

Film Formation

The above conductive layer forming coating was applied to the display screen of a cathode ray tube using a spin coater, and after drying, the above transparent layer forming coating was similarly applied to this coated surface using a spin coater. This cathode ray tube was then placed in a dryer and baked for one hour at 150° C. to form a transparent conductive film and produce the cathode ray tube of Comparative Example 5 having an anti-reflecting transparent conductive film.

(Evaluation Testing)

The performance of the low-reflecting transparent conductive films formed on the cathode ray tubes was tested using the devices or methods described below, or the appearance was evaluated by visual observation.

Film thickness: Measured by SEM (Scanning Electron Microscopy) observation

Surface resistance: Mitsubishi Chemical Corporation "Loresta AP" (four terminal probe method)

Electromagnetic wave shielding: Calculated according to the previously indicated Equation 1 based on 0.5 MHz Salt water resistance: 0.5 MHz electromagnetic wave shielding effects after immersing for 3 days in salt water Transmittance: Tokyo Denshoku Co., Ltd. Japan "Automatic Haze Meter HIII DP"

Haze: Tokyo Denshoku Co., Ltd. Japan "Automatic Haze Meter HIII DP"

Transmittance difference: The difference between maximum transmittance and minimum transmittance in the visible light region was determined using the Hitachi Ltd. "U-3500" self-recording spectrophotometer. (The smaller the difference between the maximum transmittance and minimum transmittance in the visible light region is, the flatter the transmittance, and the closer the hue of transmitted images approaches natural coloring is, and when 10% or less in particular, the dark portions of transmitted images approach black allowing the obtaining of more deeply colored images.)

Transmitted color: The color (a*, b*) values of transmitted colors in the visible light region were determined using the Hitachi Ltd. "U-3500" self-recording spectrophotometer. (As the "a*","b*" color value of transmitted colors in the visible light region approaches zero, transmitted color becomes blacker. In addition, if the value of "a*" becomes negative, black color becomes tinted with blue which is most strongly perceived as black by the human eye, thereby enabling the hue of transmitted images to become more vivid.)

Visible reflectance: EG&G Gamma Scientific "Model C-11"

Scratch test: The film surface was rubbed with the metal end of a mechanical pencil under a load of 1 kg followed by visual evaluation of the degree of scratching.

○: Not scratched

Δ: Slightly scratched x: Scratched

Visibility: Overall evaluation of low reflection performance, reflected color and transmitted colors.

The results of evaluation testing are shown in Tables 1 and 2.

TABLE 1

| | Film thickness (nm) | Surface resistance (Ω/□) | 0.5 MHz electromagnetic wave shielding (dB) | Salt water resistance (dB) | Trans-mittance (%) | Trans-mittance difference (%) | Transmitted color (a*, b*) |
|---|---|---|---|---|---|---|---|
| Embodiment. 1 | 25 | $7 \times 10^2$ | 81 | 81 | 80.4 | 8 | −0.55, 3.56 |
| Embodiment. 2 | 25 | $2 \times 10^2$ | 86 | 86 | 80.3 | 5 | −0.63, 1.97 |
| Embodiment. 3 | 25 | $5 \times 10^2$ | 82 | 82 | 79.6 | 3 | −1.09, 0.55 |
| Embodiment. 4 | 25 | $1 \times 10^2$ | 89 | 89 | 79.7 | 4 | −1.10, 0.63 |
| Embodiment. 5 | 25 | $1 \times 10^2$ | 86 | 86 | 80.3 | 3 | −0.48, 0.43 |
| Embodiment. 6 | 25 | $1 \times 10^2$ | 89 | 89 | 80.1 | 3 | −0.58, 0.79 |
| Comp. Ex. 1 | 25 | $8 \times 10^2$ | 80 | 80 | 80.3 | 11 | −0.31, 5.13 |
| Comp. Ex. 2 | 25 | $2 \times 10^2$ | 86 | 59 | 81.3 | 17 | 0.05, 12.09 |
| Comp. Ex. 3 | 25 | $8 \times 10^2$ | 80 | 80 | 80.9 | 11 | −0.41, 5.07 |
| Comp. Ex. 4 | 25 | $1 \times 10^2$ | 89 | 89 | 79.6 | 5 | 0.78, −1.12 |
| Comp. Ex. 5 | 25 | $2 \times 10^2$ | 86 | 70 | 80.5 | 9 | −0.51, 5.98 |

TABLE 2

| | Haze (%) | Scratch test | Visual reflectance (%) | Visibility |
|---|---|---|---|---|
| Embodiment. 1 | 0.0 | ○ | 0.50 | ○ |
| Embodiment. 2 | 0.0 | ○ | 0.45 | ○ |
| Embodiment. 3 | 0.0 | ○ | 0.35 | ○ |
| Embodiment. 4 | 0.0 | ○ | 0.87 | ○ |
| Embodiment. 5 | 0.0 | ○ | 0.55 | ○ |
| Embodiment. 6 | 0.0 | ○ | 0.66 | ○ |
| Comp. Ex. 1 | 0.0 | ○ | 0.61 | X |
| Comp. Ex. 2 | 0.0 | ○ | 0.50 | X |
| Comp. Ex. 3 | 0.0 | ○ | 0.63 | X |
| Comp. Ex. 4 | 0.0 | ○ | 0.93 | X |
| Comp. Ex. 5 | 0.0 | ○ | 0.51 | X |

Based on the results of Tables 1 and 2, as compared with the cathode ray tubes of Comparative Examples 1 through 3, those of Embodiments 1 through 6 can be seen to have a transmittance difference of 10% or less and hues of transmitted images that approach natural color, the dark portions of transmitted images approach black, and deep images are obtained. In addition, with respect to transmitted color as well, in contrast to the values of "a*", "b*" of the cathode ray tubes of Embodiments 1 through 6 approaching zero and the value of "a*" being negative, the value of "b*" of the cathode ray tubes of Comparative Examples 1 through 3 and 5 are large at 5 to 12, while the values of "a*" in Comparative Examples 2 and 4 are positive. Thus, in comparison with the cathode ray tubes of Comparative Examples 1 through 5, the cathode ray tubes of Embodiments 1 through 6 have black color tinted with blue, which is most strongly perceived as black by the human eye, and the hue of the transmitted images can be understood to be vivid. In addition, in comparison with Comparative Example 2 of the prior art which only uses silver fine particles, salt water resistance can be seen to be significantly improved.

INDUSTRIAL APPLICABILITY

Since the transparent conductive film of the present invention has a conductive layer containing at least ruthenium fine particles and gold fine particles, in addition to having superior anti-static effects and electromagnetic wave shielding effects, it also has superior chemical stability, and when applied to the display screen of a display device, the transmitted images exhibit a black color tinted with blue and contrast is improved, thereby allowing the obtaining of vivid images having superior visibility.

What is claimed is:

1. A transparent conductive film having a conductive layer containing at least ruthenium fine particles and gold fine particles, the weight ratio of the ruthenium fine particles and gold fine particles in said conductive layer being within the range of 40:60 to 99:1.

2. The transparent conductive film according to claim 1 wherein, silver fine particles are additionally contained in the conductive layer.

3. The transparent conductive film according to claim 2 wherein, the silver fine particles are contained at 1–70 wt % relative to the total amount of ruthenium fine particles and gold fine particles.

4. The transparent conductive film according to claim 1 wherein, the conductive layer is formed by applying a coating containing at least ruthenium fine particles and gold fine particles.

5. The transparent conductive film according to claim 2 wherein, the conductive layer is formed by applying a coating containing at least ruthenium fine particles, gold fine particles and silver fine particles.

6. The transparent conductive film according to claim 1 that contains a colorant.

7. The transparent conductive film according to claim 1 wherein, at least one transparent layer having a refractive index different from that of the conductive layer is laminated for the upper layer and/or lower layer of the conductive layer.

8. A display device comprising the formation of the transparent conductive film according to claim 1 on a display screen.

* * * * *